US006183312B1

(12) United States Patent
Yamamoto

(10) Patent No.: US 6,183,312 B1
(45) Date of Patent: Feb. 6, 2001

(54) ELECTRICAL CONTACT

(75) Inventor: Toru Yamamoto, Kawasaki (JP)

(73) Assignee: The Whitaker Corporation, Wilmington, DE (US)

( * ) Notice: Under 35 U.S.C. 154(b), the term of this patent shall be extended for 0 days.

(21) Appl. No.: 09/308,011

(22) PCT Filed: Nov. 11, 1997

(86) PCT No.: PCT/US97/20497

§ 371 Date: May 11, 1999

§ 102(e) Date: May 11, 1999

(87) PCT Pub. No.: WO98/21784

PCT Pub. Date: May 22, 1998

(30) Foreign Application Priority Data

Nov. 12, 1996 (JP) ..... 8-315469

(51) Int. Cl.[7] ..... H01R 13/432

(52) U.S. Cl. ..... 439/748; 439/746; 439/871; 439/752.5

(58) Field of Search ..... 439/748, 746, 439/872, 595, 871, 744, 752.5, 680

(56) References Cited

U.S. PATENT DOCUMENTS

| | | | | |
|---|---|---|---|---|
| 3,656,093 | * | 4/1972 | Kinkaid | 439/744 |
| 3,976,348 | | 8/1976 | Simmons | 339/74 R |
| 4,030,804 | * | 6/1977 | Enomoto | 439/595 |
| 4,781,628 | | 11/1988 | Detter et al. | 439/748 |
| 5,266,056 | * | 11/1993 | Baderschneider et al. | 439/746 |
| 5,695,368 | * | 12/1997 | Joly et al. | 439/748 |

FOREIGN PATENT DOCUMENTS

| | | | |
|---|---|---|---|
| 41 31 470 | 4/1993 | (DE) | H01R/13/434 |
| 0 547 396 A2 | 11/1992 | (EP) | H01R/13/42 |
| 1 543 587 | 12/1975 | (GB) | H01R/13/42 |

* cited by examiner

*Primary Examiner*—Paula Bradley
*Assistant Examiner*—Katrina Davis

(57) ABSTRACT

The present invention provides, in a simple form, an electrical contact in which a latch member protective section, which protects a flexible latch member and prevents reverse insertion of the electrical contact into a connector housing, is structurally strengthened, and which is equipped with an anti-overstress member that prevents overstress in the flexible latch member. The electrical contact 1 is equipped with a latching section 20 which has a flexible latch member 25 that latches the contact to a connector housing. The latching section is equipped with a latch member protective section 21 comprising of outside wall portion 21*a*, which is raised upward from a side wall 22, and whose upper end protrudes upward beyond the free end of the flexible latch member 25, and an inside wall portion 21*b*, which is folded downward from an upper end of the outside wall portion 21*a*, and an anti-overstress member 24, which is bent toward another side wall 23 from the inside wall portion 21*b*, so that the anti-overstress member 24 can be engaged by the flexible latch member 25.

8 Claims, 2 Drawing Sheets

ELECTRICAL CONTACT

FIELD OF THE INVENTION

The present invention relates to an electrical contact that has a contact section that mates with a mating contact, and an electrical wire connection section. More specifically, the present invention relates to an electrical contact provided with a flexible latching member that is latchable to a connector housing.

BACKGROUND OF THE INVENTION

A conventional electrical contact shown in FIGS. 6A, 6B and disclosed in Japanese Utility Model Laid-Open No. 145492/77 has a contact section 110 that mates with a mating contact (not shown); a wire crimp section that includes a wire barrel 131 and an insulation barrel 132 and is connected with an electrical wire (not shown) by crimping thereto; and a latching section 120 disposed between the contact section 110 and the wire crimp section 130, and that is latched to a connector housing (not shown). The electrical contact 100 is formed by stamping and forming a metal sheet.

Among these sections, the contact section 110 is formed substantially in the shape of a box that has a base member 111, a pair of side walls 112, that are raised from both sides of the base member 111, and top plates 113, that are bent inward from the side walls 112 so that a tab or post-mating contact can be accommodated therein. A plurality of spring contact members 114,115 engage the mating contact and are disposed so that the spring contact members extend rearward and approach each other from the front ends of the base member 111 and top plates 113 (i.e., the left end in FIG. 6B).

The latching section 120 has a flexible member 121 that is cut and raised from base member 111 so that flexible latch member 121 rises upward as shown in FIG. 6B) toward the rear from the base member 111, and a pair of side wall portions 122 extending rearward from the respective side walls 112 of the contact section 110, and whose upper ends are located beyond the free end of the latch member 121. The side wall portions 122 prevent the electrical wire from becoming entangled with the latch member 121 during crimping, and also act to prevent reverse insertion of the electrical contact 100 when the electrical contact 100 is inserted and held in the connector housing.

However, in this conventional electrical contact 100, since the side wall portions 122 of the latching section 120 are respectively constructed from a single metal sheet, side wall portions 122 are structurally weak in the direction perpendicular to the plane of the page in FIG. 6B). As a result, the side wall portions 122 may bend inward or outward during wire crimping or during contact insertion, so that the protective function of the side wall portions 122 with respect to the latch member 121 can be deleteriously affected, as well as the function of side wall portions 122 in terms of preventing reverse insertion of the electrical contact 100.

Furthermore, in such a conventional electrical contact 100, there is nothing that engages the latch member 121 in cases where the latch member 121 flexes downward to an excessive degree. Accordingly, in the case of excessive downward flexing of the latch member 121, overstress cannot be prevented, and deformation of the latch member 121 may occur.

SUMMARY OF THE INVENTION

Accordingly, a feature of the present invention is to provide, in a simple form, an electrical contact in which a latch member protective section protecting a flexible latch member and preventing reverse insertion of the electrical contact into a connector housing, is structurally strengthened, and the contact is equipped with an anti-overstress member that prevents overstress of the flexible latch member.

An electrical contact of the present invention comprises a contact section having a spring contact member, a latching section having a flexible latch member, and a latch member protective section, wherein the latch member protective section includes an outside wall portion extending upward from a side wall of the latch member protective section, an inside wall portion extending downward from an upper end of the outside wall portion, and an anti-overstress member extending from an inner end of the inside wall portion toward the other side wall of the latch member protective section so that the anti-overstress member can be engaged by the flexible latch member.

BRIEF DESCRIPTION OF THE DRAWINGS

The invention will now be described by way of example with reference to the accompanying drawings in which:

FIGS. 6A and 6B show a conventional electrical contact with FIG. 6A being a perspective view of the electrical contact, while FIG. 6B is a longitudinal cross-sectional view of the electrical contact taken along line 6B—6B of FIG. 6A.

DETAILED DESCRIPTION

Figure 1:
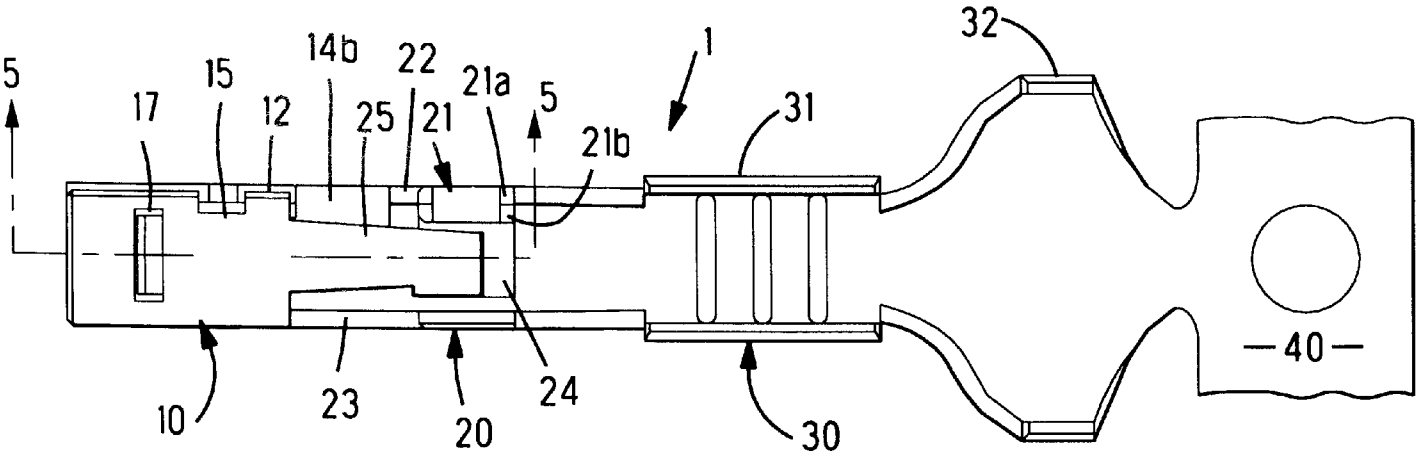
FIG. 1 is a plan view that shows an electrical contact of the present invention together with a carrier strip.
Figure 2:
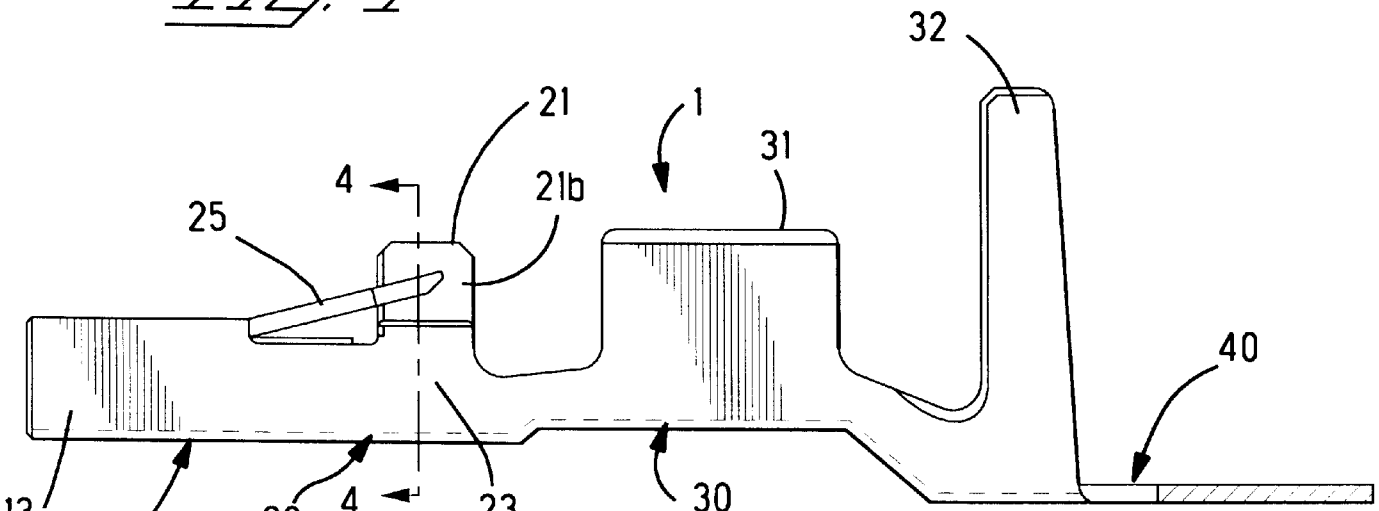
FIGS. 2 and 3 are right-side and front views of the electrical contact shown in FIG. 1.
Figure 3:
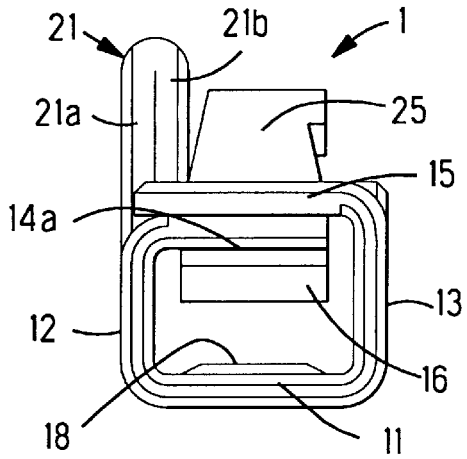
Figure 4:
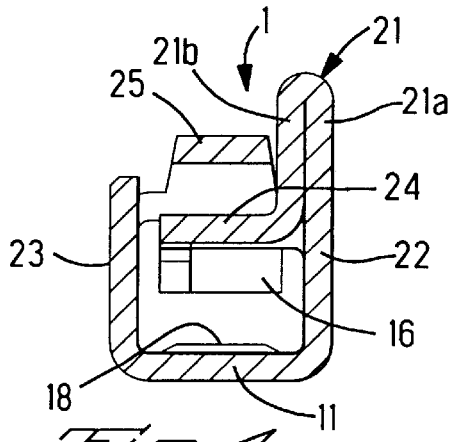
FIGS. 4 and 5 are cross-sectional views taken along lines 4—4 and 5—5 in FIGS. 2 and 1 respectively.
Figure 5:
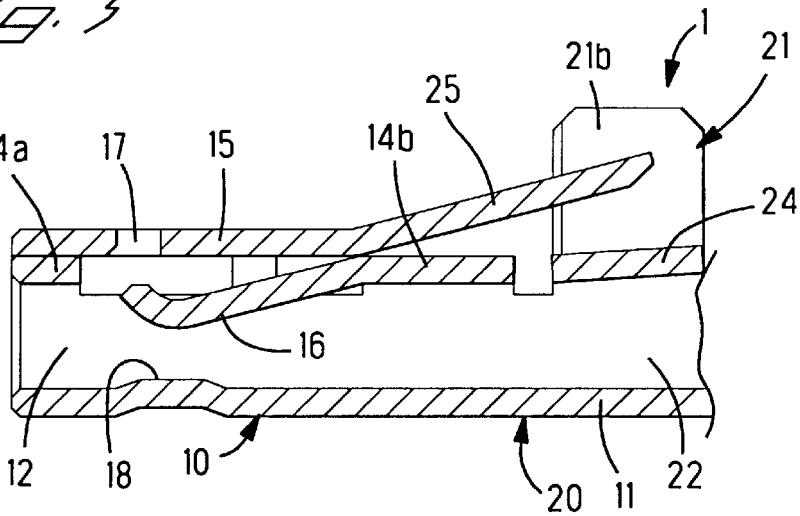
Figure 6A:
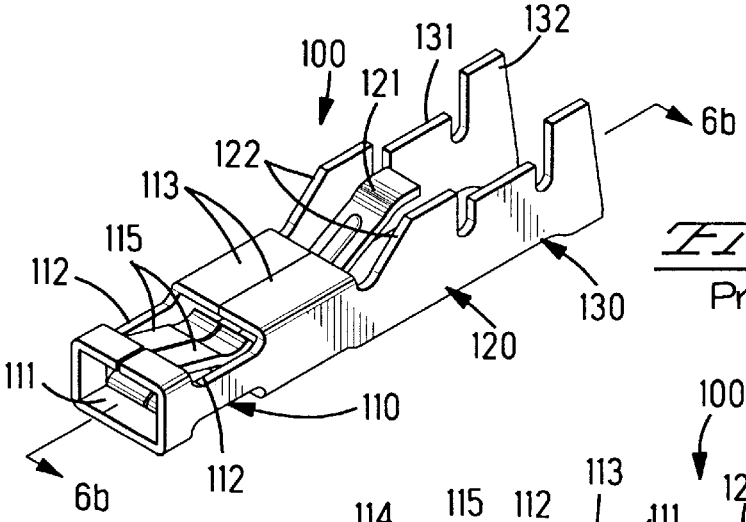
Fig. 6a Prior Art
Figure 6B:
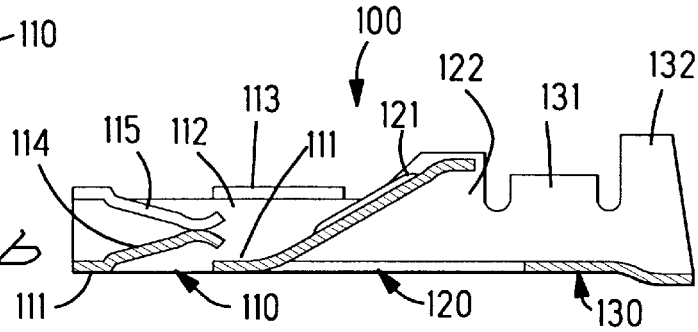
Fig. 6b Prior Art

As shown in FIGS. 1 to 5, electrical contact 1 has a contact section 10, that mates with a mating contact (not shown), an electrical wire connection or crimp section 30 that includes a wire barrel 31 and an insulation barrel 32, and that is to be electrically connected to an electrical wire, and a latching section 20, that is disposed between the contact section 10 and wire crimp section 30. Contact 1 is formed by stamping and forming a metal sheet, and in FIGS. 1 and 2, the contact is connected to a carrier strip 40 that is cut away after contact 1 has been manufactured, electrically connected to an electrical wire or inserted into a connector housing.

Contact section 10 is formed substantially in the shape of a box that has a base member 11, a pair of side walls 12 and 13, lower top walls 14*a* and 14*b* that are bent inward from an upper end of one of the side walls 12 (i.e., the upper end in FIG. 5) at the front end (left end in FIG. 5) of the contact section 10 and at the rear of the contact section 10, and an upper top wall 15 that is bent inward from an upper end of the other side wall 13, so that a tab or post-mating contact can be accommodated therein. A spring contact member 16 is provided that extends forward and downward from the lower top wall 14*b* at the rear end of the contact section 10 and makes spring engagement with the mating contact, and a contact projection 18 that engages the mating contact is formed by punching in the forward portion of the base member 11. A relief slot 17 is formed in the forward portion of the upper top wall 15 and provides relief for the spring contact member 16 when the spring contact member 16 engages the mating contact and flexes upward. Since relief slot 17 is formed in the upper top wall 15, engagement of the free end of the spring contact member 16 with the upper top wall 15 can be avoided while keeping the vertical height of the contact section 10 low. Whereas contact section 10 is shown as being formed as a substantially box-shaped contact section, it would also be possible to form a circular-shaped contact section.

Latching section 20 has flexible latch member 25 bent so that it rises upward toward the rear from the upper top wall 15 of the contact section 10 and latches to a connector housing (not shown). Contact 1 also includes a pair of side walls 22 and 23 extending rearward from the respective side walls 12 and 13 of the contact section; latch member protective section 21 comprising an outside wall portion 21*a* that extends upward from one of the side walls 22, and whose upper end protrudes upward beyond the free or upper end of the flexible latch member 25; and an inside wall portion 21*b* that is folded downward from the upper end of the outside wall portion 21*a*. Outside and inside wall portions 21*a*, 21*b* extend alongside one another and are preferably in engagement. Since the latch member protective section 21 is constructed from two metal plates (i.e., outside wall portion 21*a* and inside wall portion 21*b* connected thereto) latch member protective section 21 is structurally strong in the inside-outside direction (i.e., the left-right direction in FIG. 4). Accordingly, there is little likelihood that the latch member protective section 21 will be bent in the inside-outside direction during the electrical wire connection operation, or during the installation of the contact in the connector housing. Thus, there is no loss of the flexible latch member protective function, and this prevents the electrical wire from becoming entangled with the flexible latch member 25 and also prevents reverse insertion during contact insertion.

Latching section 20 has an anti-overstress member 24 bent toward the other side wall 23 from the inside wall portion 21*b* of the latch member protective member 21, and capable of engaging the underside of the flexible latch member 25. Accordingly, in cases where the flexible latch member 25 flexes downward to an excessive degree, the free end of the flexible latch member 25 engages the upper surface of the anti-overstress member 24, so that deformation of the flexible latch member 25 can be prevented. Furthermore, since the anti-overstress member 24 is not formed by being cut and raised from one of the side walls 22 and 23 constituting the latching section 20, but is instead formed by being bent from the inside wall portion 21*b* that is bent from the outside wall portion 21*a*, there is no decrease in the strength of the side walls 22 and 23.

Furthermore, the anti-overstress member 24 may also be mounted on or fastened to the surface of the other side wall 23. If this is done, both ends of the anti-overstress part 24 will be supported; in such a case, therefore, the strength of the anti-overstress member 24 against bending is increased, and deformation of the anti-overstress member itself is prevented. Anti-overstress member 24 may also be disposed on the other side wall 23.

In the electrical contact of the present invention, the latching section is equipped with a latch member protective section comprising an outside wall portion that extends upward from one of the side walls of the contact section, and whose upper end protrudes upward beyond the free end of the flexible latch member, and an inside wall portion, that is folded downward from an upper end of the outside wall portion. Accordingly, the latch member protective section is constructed from two metal plates, and is therefore structurally strong in the inside-outside direction. As a result, there is little likelihood that the latch member protective section will be bent in the inside-outside direction during the electrical wire connection operation, or during the installation of the electrical contact in the connector housing. Thus, there is no loss of the flexible latch member protective function that prevents the electrical wire from becoming entangled with the flexible latch member, or of the function that prevents reverse insertion when the electrical contact is inserted into the connector housing. Furthermore, the latching section is equipped with an anti-overstress member that is bent toward the other side wall from the inside wall portion of the latch member protective section, and that is capable of engaging the underside of the flexible latch member. Accordingly, in cases where the flexible latch member flexes downward to an excessive degree, the flexible latch member engages the anti-overstress member, so that overstress and deformation of the flexible latch member can be prevented. Also, since the anti-overstress member is not formed by being cut and raised from one of the side walls constituting the latching section, but is instead formed by being bent from the inside wall portion that is bent from the outside wall portion, there is no decrease in the strength of the side walls.

What is claimed is:

1. An electrical contact comprising a contact section (10) having a spring contact member (16), a latching section (20) having a flexible latch member (25), and a latch member protective section (21), characterized in that:

the latch member protective section (21) includes an outside wall portion (21*a*) extending upwardly from a side wall (22) of the latch member protective section, an inside wall portion (21*b*) continuous with and extending downwardly from an upper end of the outside wall portion (21*a*), and an anti-overstress member (24) continuous with and extending from an inner end of the inside wall portion (21*b*) toward the other side wall (23) of the latch member protective section (21) so that the anti-overstress member (24) can be engaged by the flexible latch member (25).

2. An electrical contact as claimed in claim 1, wherein the upper end of said outside wall portion (21*a*) protrudes upward beyond the free end of the flexible latch member (25).

3. An electrical contact as claimed in claims 1 and 2, wherein said spring contact member (16) is cut out from a lower top wall (14*b*) and extends forwardly toward a front tend of said contact section (10).

4. An electrical contact as claimed in claim 1, wherein the outside wall portion (21*a*) and the inside wall portion (21*b*) extend alongside one another.

5. An electrical contact as claimed in claim 1, wherein a free end of said spring contact member (16) is bent toward an upper top wall (15) of said contact section (10).

6. An electrical contact as claimed in claim 5, wherein said upper top wall (15) includes a slot (15) to receive the free end of said spring contact member (16).

7. An electrical contact comprising a contact section (10) having a spring contact member (16), a latching section (20) having a flexible latch member (25), and a latch member protective section (21), characterized in that the latch member protective section (21) includes an outside wall plate (21*a*) extending upwardly from a side wall (22) of the latch member protective section, an inside wall plate (21*b*) attached to and extending downwardly from an upper end of the outside wall plate (21*a*), and an anti-overstress member (24) attached to and extending from an inner end of the inside wall plate (21*b*) toward the other side wall (23)

of the latch member protective section (21) so that the anti-overstress member (24) can be engaged by the flexible latch member (25).

8. An electrical contact comprising a contact section (10) having a spring contact member (16), a latching section (20) having a flexible latch member (25), and a latch member protective section (21), characterized in that the latch member protective section (21) includes an outside wall portion (21*a*) extending upwardly from a side wall (22) of the latch member protective section, an inside wall portion (21*b*) integral with the outside wall portion (21*a*) and extending downwardly from an upper end of the outside wall portion (21*a*), and an anti-overstress member (24) integral with the inside wall portion (21*b*) and extending from an inner end of the inside wall portion (21*b*), to which the anti-overstress member is joined, toward the other side wall (23) of the latch member protective section (21) so that the anti-overstress member (24) can be engaged by the flexible latch member (25).

* * * * *